United States Patent [19]

Hoekje et al.

[11] 4,040,934

[45] Aug. 9, 1977

[54] BIPOLAR ELECTROLYZER HAVING SILICON LAMINATE BACKPLATE

[75] Inventors: Howard H. Hoekje, Akron; Gordon A. Carlson, Wadsworth; Robert B. Simmons, Norton, all of Ohio

[73] Assignee: PPG Industries, Inc., Pittsburgh, Pa.

[21] Appl. No.: 632,048

[22] Filed: Nov. 14, 1975

[51] Int. Cl.[2] ..... C25B 11/04

[52] U.S. Cl. ..... 204/256; 204/268; 204/290 F

[58] Field of Search ..... 204/256, 268, 255, 290 F, 204/279, 280

[56] References Cited

U.S. PATENT DOCUMENTS

| | | | |
|---|---|---|---|
| 3,836,450 | 9/1974 | Schultz et al. | 204/290 F |
| 3,852,175 | 12/1974 | Hoekje | 204/290 F X |
| 3,856,651 | 12/1974 | Raetzsch et al. | 204/256 X |
| 3,862,023 | 1/1975 | Johnson | 204/290 F |
| 3,884,792 | 5/1975 | McGilvery | 204/256 X |
| 3,919,059 | 11/1975 | Raetzsch et al. | 204/256 X |
| 3,926,770 | 12/1975 | Hoekje | 204/256 |

*Primary Examiner*—C. F. Lefevour
*Attorney, Agent, or Firm*—Richard M. Goldman

[57] ABSTRACT

Disclosed is a bipolar electrolyzer having a plurality of bipolar units space from and parallel to each other with a pair of bipolar units defining a single electrolytic cell therebetween. Each of the bipolar units has an anode on one surface and a cathode on the opposite surface, so that the cathode of one bipolar unit faces the anode of the next adjacent bipolar unit. A steel plate is one exposed surface of the backplate and a silicon sheet in electrical contact with the steel plate is the opposite exposed surface of the backplate. The steel plate and the silicon sheet are bonded together with a suitable electroconductive bonding material.

2 Claims, 4 Drawing Figures

BIPOLAR ELECTROLYZER HAVING SILICON LAMINATE BACKPLATE

DESCRIPTION

A bipolar electrolyzer is an electrolyzer having a plurality of individual electrolytic cells mechanically and electrically in series. In a bipolar electrolyzer, the cathodes of one cell and the anodes of the next adjacent cell form a common structural unit of the electrolyzer with the cathodes of one cell and the anodes of the next adjacent cell being in back-to-back configuration on a common structural member.

The common structural member, equivalently referred to as a backplate, a bipolar unit, and as a bipolar electrode, provides electrolyte tight, leak-proof integrity between adjacent cells, while conducting electricity between the adjacent cells. A backplate has an anolyte resistant side or surface in contact with anolyte liquor of one individual cell and a catholyte resistant side or surface in contact with the catholyte liquor of the adjacent individual electrolytic cell.

The anolyte resistant side or surface may be the anode itself. Alternatively, anodes may be supported from the backplate. In a diaphram-type cell, it is particularly important that the anolyte resistant surface be protected from contact with strongly basic catholyte liquor.

The opposite side of the backplate is catholyte resistant side. In a chlorine cell, the catholyte resistant side has cathodes supported by the backplate, for example, an electrolyte permeable plate or sheet parallel to the backplate or parallel sheets or plates extending outwardly from the backplate. The electrolyte permeable cathode has a diaphragm on the external surface of the cathode thereby defining a catholyte volume between the diaphragm and the catholyte resistant surface of the backplate. It is particularly important that the catholyte resistant material be protected from contact with strongly acidic anolyte liquor, for example, from anolyte liquor seeping into and through the backplate.

In an assembled electrolytic cell, the anodic means of one bipolar unit, that is either the anolyte resistant surface of the backplate with an electroconductive material thereon or anode plates extending outwardly therefrom, faces the catholyte resistant surface of the next adjacent backplate, the next adjacent backplate having cathode means depending from the surface thereof, facing the first backplate, and defining a single electrolytic cell therebetween.

In the operation of an electrolytic diaphragm cell, such as is used to electrolyze sodium chloride, potassium chloride, or hydrochloric acid, reagent is fed into the anolyte chamber and an electrolytic current is passed through the cell. Chlorine is evolved at the anode, hydrogen is evolved at the cathode, in the case of a potassium chloride or sodium chloride feed the corresponding hydroxide is formed in the catholyte chamber.

In the operation of commercial chlorine-caustic soda diaphram cells, brine containing from about 280 to about 325 grams per liter of sodium chloride is fed into the anolyte chamber of the cell. An electromotive force is established between the anode and the cathode with chlorine being evolved at the anode. The anolyte liquor, containing sodium chloride, passes through the diaphram to the catholyte chamber. In the catholyte chamber, hydrogen is evolved at the cathode and catholyte liquor containing from about 7 to about 15 weight percent sodium chloride and from about 10 to about 15 weight percent sodium hydroxide is recovered.

In an alternative process, where potassium chloride is electrolyzed and chlorine and caustic potash are recovered, brine containing from about 350 to about 425 gtams per liter of potassium chloride is fed into the anolyte chamber of the cell. An electromotive force is established between the anode and the cathode. Chlorine is evolved at the anode while anoltye liquor containing potassium chloride passed through the diaphram to the catholyte chamber where hydrogen is evolved at the cathode and catholyte liquor containing from about 9 to about 20 weight percent of potassium chloride and from about 14 to about 21 weight percent of potassium hydroxide is recovered.

In the electrolysis of hydrochloric acid, such as the by-product of organic syntheses of chlorinated hydrocarbons, the hydrochloric acid may be fed to both compartments of the cell or to the anolyte compartment only. Chlorine is evolved at the anode while hydrogen is evolved at the cathode.

Anode materials may be provided by graphite, by film-forming metals or valve metals having a suitable electroconductive, electrocatalytic surface thereon, or by silicon. Silicon is particularly outstanding because it is not attacked by acids or acidified brine and it can be rendered electroconductive by the addition of dopants such as boron, aluminum, gallium, indium, thallium, nitrogen, phosphorous, arsenic, antiomy, and bismuth.

A particularly desirable silicon material useful in providing anodic materials is a silicon alloy containing sufficient dopant to provide an electrical conductivity in excess of 100 (ohm-centimeters)$^{-1}$,and balance silicon, with trace amounts of impurities being tolerable. Such an alloy typically contains from about 0.1 to about 2.5 weight percent of the dopants numerated above the balance silicon.

Unfortunately, silicon is subject to attack by strongly basic catholyte liquor. It has now been found, however, that a particularly satisfactory cell configuration is provided by a bipolar electrolyzer having a laminated backplate where a silicon sheet is the anolyte side of the backplate, an iron plate provides the catholyte side of the backplate, and a bonding material, for example, a resilient, electrically conductive bonding material, is provided therebetween. Preferably, the bonding material should be sufficiently electrically conductive that a resonable amount may be used without a significant loss in voltage, and yet sufficiently resilient to allow for the differences in the coefficients or thermal expansion and Young's modulus of elasticity of iron and silicon. That is, it should be sufficiently resilient to allow the more elastic iron or steel plate of the backplate to deform without thereby cracking or shattering the silicon.

THE FIGURES

dDETAILED DESCRIPTION OF THE INVENTION

Figure 1:
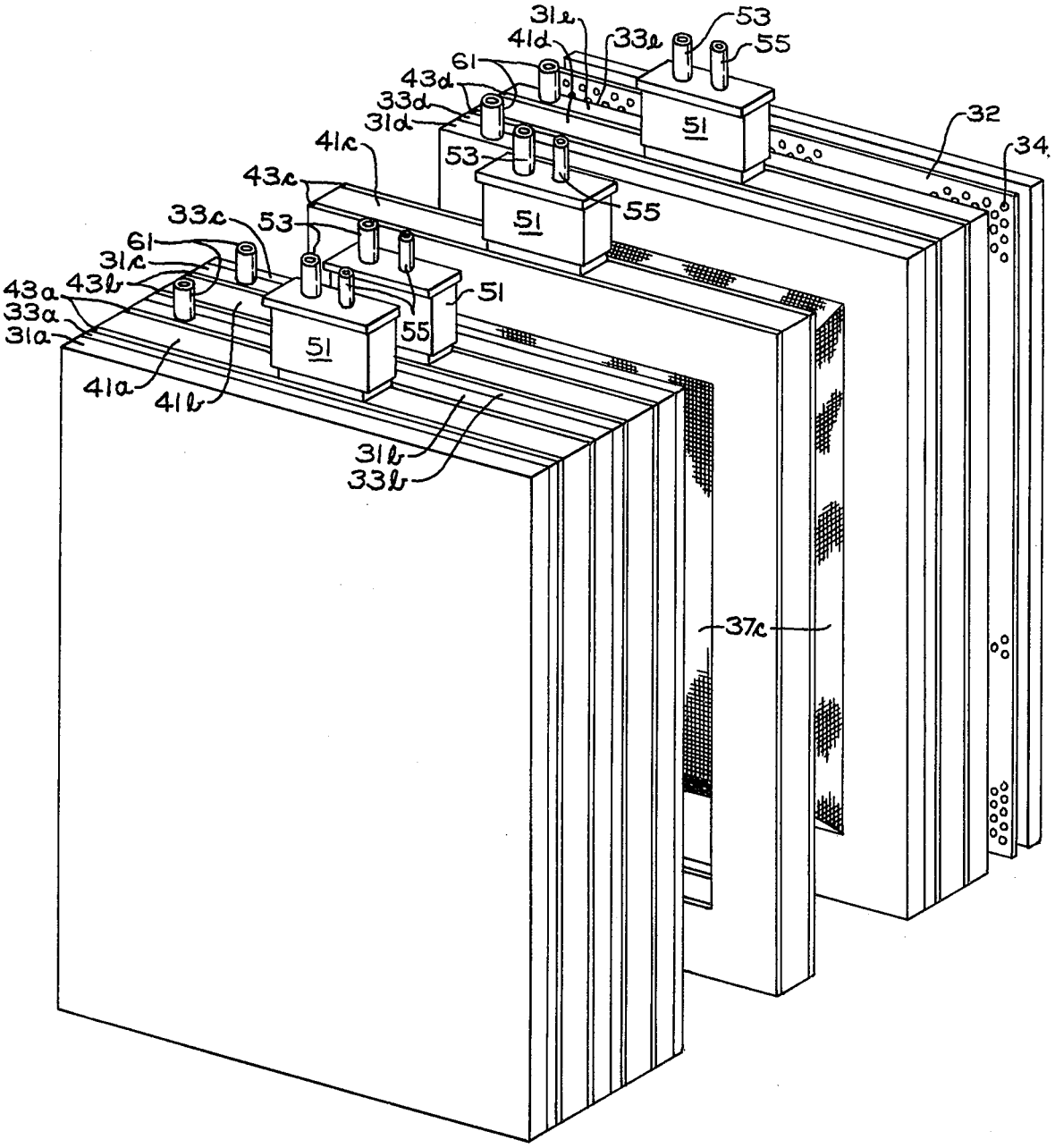
FIG. 1 is a partially exploded cutaway view of a bipolar electrolyzer.

A bipolar electrolyzer 1 is shown in exploded view in FIG. 1. The bipolar electrolyzer has individual bipolar units 11, 12, and 13 forming an individual diaphragm cell 21 between bipolar units 11 and 12 and an individual diaphragm cell 22 between bipolar units 12 and 12. The individual bipolar units are comprised of steel plates 31*a*, 31*b*, 31*c* on the catholyte facing sides of the units and silicon sheets 33*a*, 33*b*, 33*c* on the opposite sides of the bipolar units. Steel cathode screens 35*a*, 35*b*, extend outwardly from and parallel to the steel plates 31*b*, 31*c* with permeable barriers 37*a*, 37*b* thereon Spacers 41*a*, 41*b*, 41*c* separate the steel catholyte surface of the individual backplates 12 and 13 from the silicon anolyte-resistant surfaces 33*a*, 33*b* of the individual bipolar units 11 and 12 with first rubber gasket means 43*a*', 43*b*' between the the resilient spacers 41*a*, 41*b*and the steel surface of the steel plate 31*b*, 31*c* of the individual bipolar units 12, 13 and second rubber gasket means 43*a*"43*b*"between the silicon sheets 33*a*, 33*b* of the individual bipolar units 11 and 12 and the resilient spacers 41*a*, 41*b*.

Extending outwardly from the resilient spacers 41*a*, 41*b*, 41*c* are brine boxes 51 which have chlorine outlets 53 and brine feed means 55. Gas outlets, for example, hydrogen gas outlets 61, extend outwardly from the steel plates 31*a*, 31*b*, 31*c* of the individual bipolar units 11, 12, and 13.

The individual bipolar units are joined together with the anode means of one bipolar unit facing the cathode means of the next adjacent bipolar unit to form an electrolyzer. The electrolyzer is joined together by tie rods 73 extending through holes 71 and extended portions of the steel plate 31 of individual bipolar units, for example, 11. In this way, the extended or flanged portions on every fifth or eighth or tenth unit may be used to provide a compressive force on the individual units of the bipolar electrolyzer. The tie rod applies compressive force through nut 75 on the flanged portion of the backplate 11 and is electrically separated therefrom by a nonconductive, electrically insulating washer 77. The tie rod is separated from the backplate by a sleeve preventing electrical contact between the tie rod and the interior of the flanged portion of the backplate.

Figure 2:
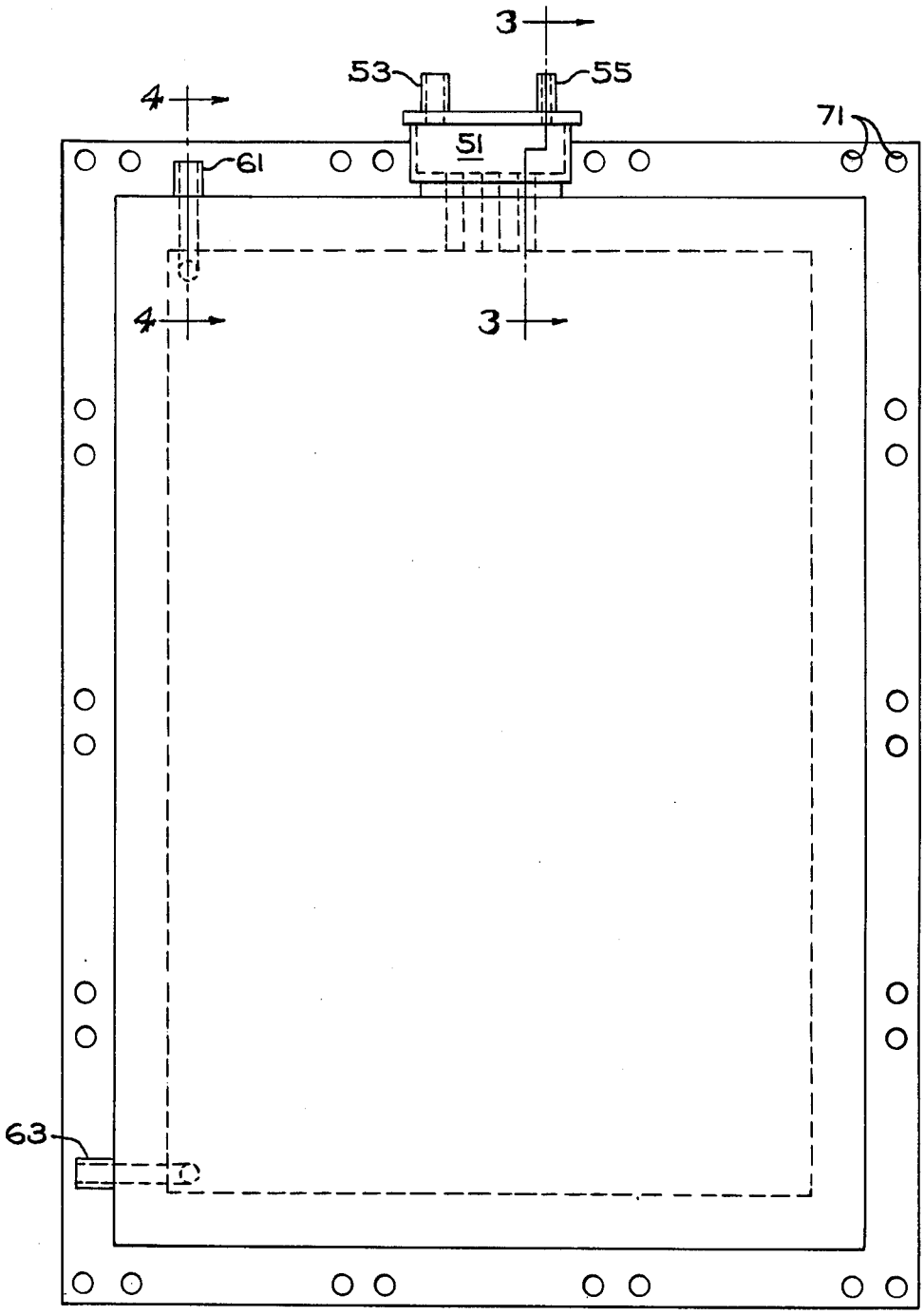
FIG. 2 is an elevation view of a bipolar unit of an electrolyzer of this invention.
Figure 4:
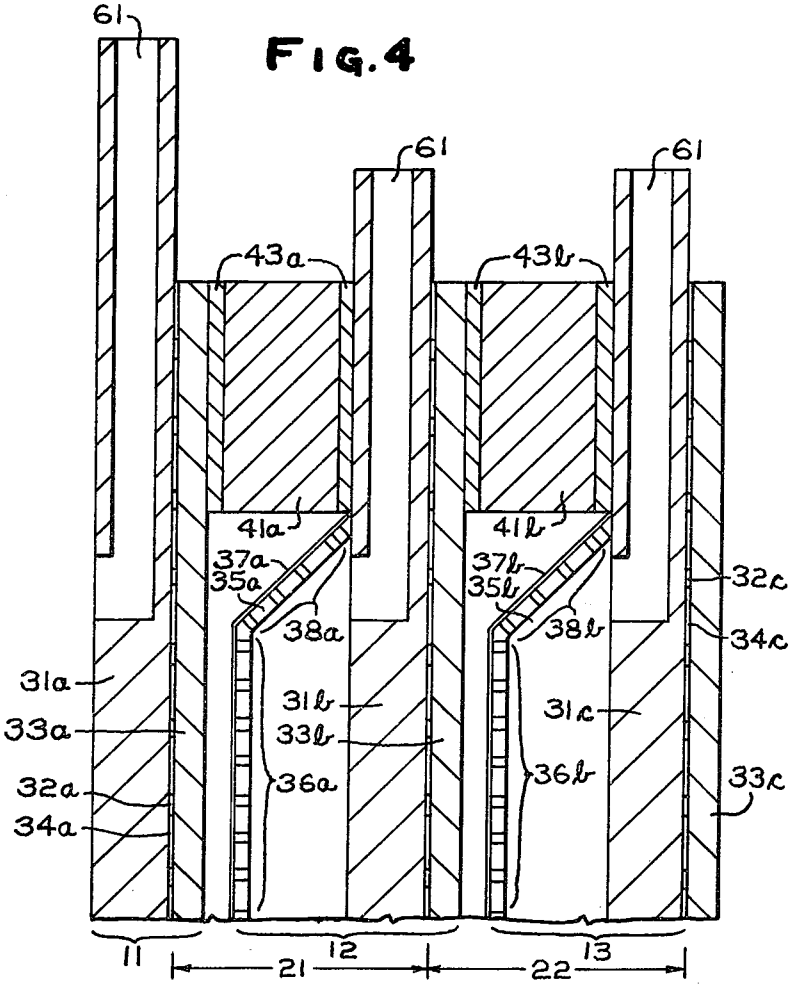
FIG. 4 is a view along plane 4—4 of FIG. 2.
Figure 3:
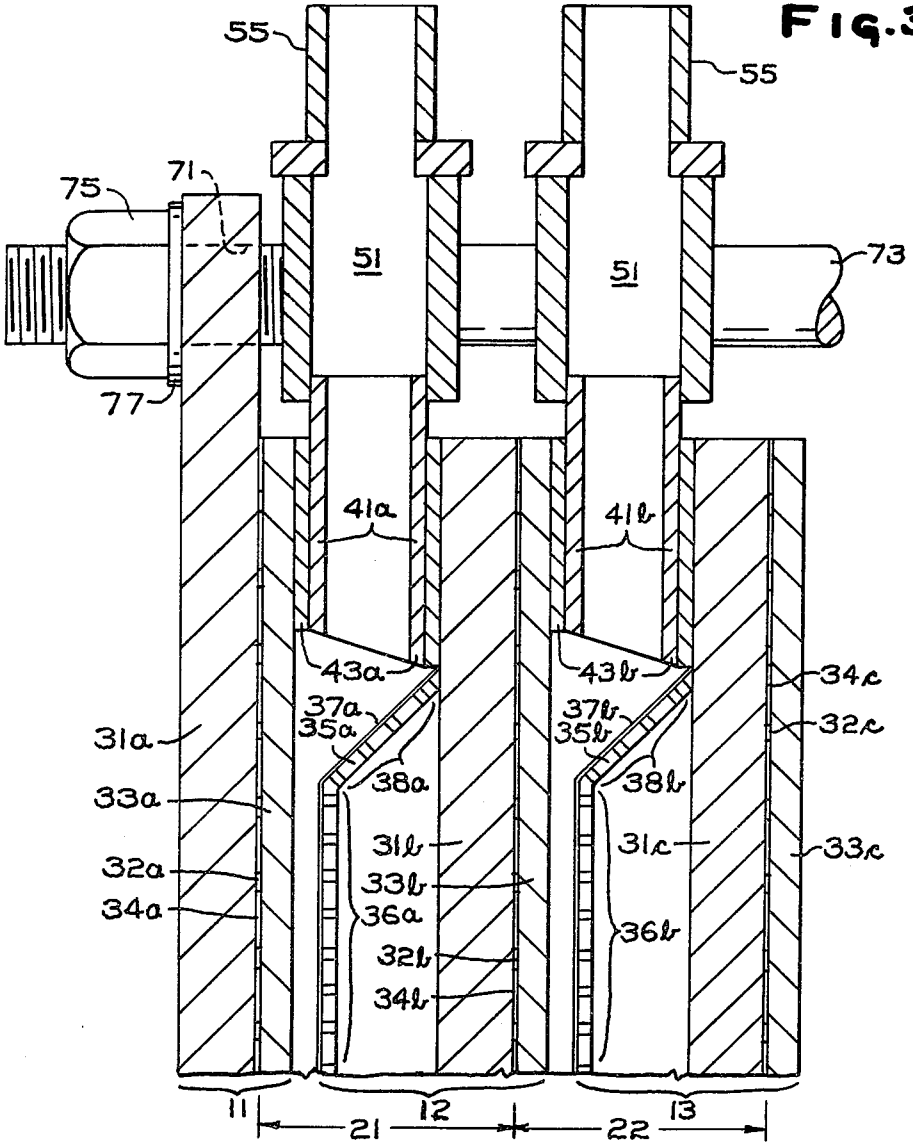
FIG. 3 is a view along plane 3–3 of FIG. 2.

FIG. 3 shows a view through cutting plane 3—3 of FIG. 2. As there shown, individual backplates 11, 12, and 13 form individual cell unit 21 between backplates 11 and 12 and individual cell unit 22 between backplates 12 and 13. Each individual backplate 11, 12, 13 is formed of a steel plate 31*a*, 31*b*, 31*c* as the catholyte resistance surface thereof and a silicon sheet 33*a*, 33*b*, 33*c* as the anolyte resistant sheet. Shown between the steel plate 31*a*, 31*b*, 31*c* and the silicon sheet 33*a*, 33*b*, 33*c* is a resilient bonding means 34*a*, 34*b*, 34*c*. The resilient bonding means may be provided by an electroconductive cement, for example, electroconductive resinous organic material such as Emerson and Cuming, "Eccobond Solder LT-11"conductive epoxy adhesive, having a volume electrical resistivity of less than 0.01 ohm-centimeter and a thermal expansion coefficient of less than $10^{-4}$ per degree centigrade, and a bond shear strength of about 1,000 pounds per square inch or higher.

The resilient bonding means may be provided by any material having a bond shear strength of greater than about 500 pounds per square inch, and a thermal expansion coefficient of less than $10^{-4}$ per degree centigrade may be utilized.

The electrical resistivity of the bonding means should be low enough to provide an economically acceptable voltage drop in a layer of bonding material that is thick enough to provide the desired resiliency. Such materials are especially desired in order to provide a compact electroconductive bond between the steel plate and the silicon sheet where the steel plate has a coefficient of thermal expansion of about $0.114 \times 10^{-4}$ per degree centigrade while the silicon sheet has a coefficient expansion of about $0.023 \times 10^{-4}$ per degree centigrade. In this way, inadvertent fracturing of the silicon sheet may be avoided.

Interposed between the steel plate 31*a*, 31*b*, 31*c* of the individual backplate 11, 12, 13 and the silicon sheet 33*a*, 33*b*, 33*c* of the individual backplate 11, 12, 13 may be a perforated, resilient shim 32*a*, 32*b*, 32*c* with means for the electroconductive bonding material to extend from the steel plate 31*a*, 31*b*, 31*c* through the perforated, resilient shim 32*a*, 32*b*, 32*c* to the silicon sheet 33*a*, 33*b*, 33*c* of the bipolar unit 11, 12, 13. In this way, further means of taking up the difference in coefficients of thermal expansion and modulus of the elasticity may be provided. The shim 32*a*, 32*b*, 32*c* is fabricated of a material that has some resiliency and that is capable of withstanding the temperatures of cell operation, e.g., about 110° C., the curing temperature of the electroconductive bonding material e.g., about 125° C. to about 175° C., suitable materials are polycarbonates and polypropylene.

As described herein, the silicon sheet 33*a*, 33*b*, 33*c* functions as the anode and has thereon a surface of material other than silicon functioning as an electrocatalyst. Typically, the electrocatalyst has chlorine overvoltage of less than 0.25 volt at a current density of 125 amperes per square foot.

A suitable method of determining chlorine overvoltage is as follows:

A two-compartment cell constructed of polytetrafluoroethylene with a diaphragm composed of asbestos paper is used in the measurement of chlorine overpotentials. A stream of water-saturated $Cl_2$ gas is dispersed into a vessel containing saturated NaCl, and the resulting $Cl_2$ saturated brine is continuosly pumped into the anode chamber of the cell. In normal operation, the temperature of the electrolyte ranges from 30° to 35° C., most commonly 32° C., at a pH of 4.0. A platinized titanium cathode is used.

In operation, an anode is mounted to a titanium holder by means of titanium bar clamps. Two electrical leads are attached to the anode; one of these carries the applied current between anode and cathode at the voltage required to cause continuous generation of chlorine. The second is connected to one input of high impedance voltmeter. A Luggin tip made of glass is brought up to the anode surface. This communicates via a salt bridge filled with anolyte with a saturated calomel half cell. Usually employed is a Beckman miniature fiber junction calomel such as catalog No. 39270, but any equivalent one would be satisfactory. The lead from the calomel cell is attached to the second input of the voltmeter and the potential read.

Calculation of the overvoltage, $\eta$, is as follows:

The International Union of Pure and Applied Chemistry sign convention is used, and the Nernst equation taken in the following form:

$$E = E_o + 2.303\ RT/nF \log [\text{oxidized}]/[\text{reduced}]$$

Concentrations are used for the terms in brackets instead of the more correct activities.

$E_o$ = the standard state reversible potential = +1.35 volts $n$ = number of electrons equivalent $^{-1} = 1$
$R$, gas constant, = 8.314 joule deg $^{-1}$ mole $^{-1}$
$F$, the Faraday = 96,500 couloumbs equivalent $^{-1}$
$Cl_2$ concentration = 1 atm
$Cl^-$ concentration = 5.4 equivalent liter $^{-1}$ (equivalent to 305 grams NaCl per liter)
$T$ = 305° K
For the reaction $$Cl^- \rightarrow \tfrac{1}{2} Cl_2 = e^-,$$

$$E = 1.35 = 0.060 \log 1/5.4 = 1.30$$

This is the reversible potential for the system at the operating conditions. The overvoltage on the normal hydrogen scale is, therefore, $$\eta = V - [E - 0.24]$$

where
$V$ is the measured voltage,
$E$ is the reversible potential, 1.30,
0.24 is the potential of the saturated calomel half cell.

The preferred materials are further characterized by their chemical stability and resistance to chlorine attack or to anodic attack in the course of electrolysis.

Suitable coating materials include the platinum group metals, platinum, ruthenium, rhodium, palladium, osmium, and iridium. The platinum group metals may be present in the form of mixtures or alloys such as palladium with platinum or platinum with iridium. An especially satisfactory palladium-platinum combination contains up to about 15 percent platinum and the balance palladium. Another particularly satisfactory coating is metallic platinum with iridium, especially when containing from about 10 to about 35 percent iridium. Other suitable metal combinations include ruthenium and osmium, ruthenium and iridium, ruthenium and platinum, rhodium and osmium, rhodium and iridium, rhodium and platinum, palladium and osmium, and palladium and iridium. The production or use of many of these coatings on other substrates are disclosed in U.S. Pat. Nos. 3,630,768, 3,491,014, 3,242,059, 3,236,756, and others.

The electroconductive material also may be present in the form of an oxide of a metal of the platinum group such as ruthenium oxide, rhodium oxide, palladium oxide, osmium oxide, iridium oxide, and platinum oxide. The oxides may also be a mixture of platinum group metal oxides, such as platinum oxide with palladium oxide, rhodium oxide with platinum oxide, ruthenium oxide with platinum oxide, rhodium oxide with iridium oxide, rhodium oxide with osmium oxide, rhodium oxide with platinum oxide, ruthenium oxide with platinum oxide, ruthenium oxide with iridium oxide, and ruthenium oxide with osmium oxide.

There may also be present in the electroconductive surface, oxides which themselves are nonconductive or have low conductivity. Such materials, while having low bulk conductivities themselves, may nevertheless provide good conductive films with the above mentioned platinum group oxide and may have open or porous structures thereby permitting the flow of electrolyte and electrical current therethrough or may serve to more tightly bond the oxide of the platinum metal to the silicone base. For example, aluminum oxide, silicon oxide, titanium oxide, zirconium oxide, niobium oxide, hafnium oxide, tantalum oxide, or tungsten oxide may be present with the more highly conductive platinum group oxide in the surface coating. Where a plurality of oxide coatings are applied, it is advantageous to apply the outer coatings as mixtures of the type here described. Carbides, nitrides, and silicides of these metals or of the platinum group metals also may be used to provide the electroconductive surface. For example, an electrode may be provided having an elemental silicon base or substrate with a surface thereon containing a mixed oxide coating comprising ruthenium dioxide and titanium dioxide, or ruthenium dioxide and zirconium dioxide, or ruthenium dioxide and tantalum dioxide. Additionally, the mixed oxide may also contain metallic platinum, osmium, or iridium. Oxide coatings suitable for the purpose herein contemplated are described in U.S. Pat. No. 3,632,408 granted to H.B. Beer.

According to a further embodiment, the silicon base electrodes of this invention may have a surface composed at least partially or even wholly of an electroconductive inert metal silicide such as silicide of a platinum group metal. The electroconductive silicide surface of the electrode may be provided by those silicides having a satisfactory electroconductivity, and further, having chemical resistance to the anolyte and the evolved anodic product. Such a silicide-containing surface may, moreover, be a combination of two or more silicides, both characterized by their substantial resistance to chemical attack by the anolyte and the evolved anodic product, but only one of the silicides having a high electrical conductivity and a low chlorine overvoltage effect in the evolution of chlorine.

Especially good electroconductive, electrolyte-resistant silicides for this purpose include silicides of the platinum group metals, that is, platinum silicide, palladium silicide, iridium silicide, rhodium silicide, and ruthenium silicide. Many such silicides have the formula $M_xSi_y$ where M is the metal and $x$ and $y$ each are 1 to 5. Other silicides having sufficiently high conductivity and fairly good chemical resistance to the anolyte products include the chromium silicide CrSi, $Cr_5Si_3$ and $CrSi_2$, cobalt silicide CoSi, nickel silicide NiSi, titanium silicide $TiSi_2$, vanadium silicide $VSi_2$, zirconium silicide $ZrSi_2$, niobium silicide, hafnium silicide, tantalum silicide $TaSi_2$, and tungsten silicide.

As a general rule several coatings of the conductive material (platinum or the like) are deposited successively one upon the other in order to build up the thickness of the coating and reduce its permeability to electrolyte. Because of the high cost of the noble metal, however, the coating is comparatively thin, usually being less than 0.001 inch, rarely over a few thousandths of an inch in thickness. Consequently, the coatings are porous and permeable to electrolyte and thus the silicon of the substrate, which contacts the conductive inner layer or layers, itself becomes exposed to anodic attack as it is used. It is especially for this reason that this silicon must be inert; otherwise the support for the coating becomes etched away and the coating flakes off the electrode.

According to a very effective embodiment, the first undercoating may be composed of a mixture of a platinum group silicide and a platinum group metal or oxide thereof or alternatively, all of the platinum group metal in such undercoating may be in the form of a silicide. This may be effectively accomplished by applying the platinum group metal or metal oxide coating to the silicon base and then heating, for example, at 500°-1,100° C. until the silicon has reacted with the coating to form a silicide of the platinum group metal, e.g., $PtSi_2$, $PdSi_2$, or $RuSi_2$. Thereafter, subsequent coatings of the platinum group metal or platinum group metal oxides may be applied. Alternatively, the outer coatings may be deposited as silicides, for example, by applying to the silicon base coatings a solution of silicon resinate or other silicon ester and platinum resinate or other platinum group resinate and heating the resulting coating at 350°–500° C. to cause production of platinum metal and the platinum silicide. In similar way, an ethyl alcohol solution of silicon tetrachloride and platinum group chloride may be applied and heated to deposit a silicide coating.

The proportion of platinum group silicide to metal or metal oxide may be varied by varying the amount of silicon resinate or other silicon ester. Generally about 1 equivalent of silicon resinate to 2 to 5 equivalents of platinum resinate is used and the coating ranges from 10 to 50 percent platinum silicide, the balance being platinum metal.

Other electroconductive coatings which may be deposited on the silicon base are the bimetal and trimetal spinels. Such spinels include $MgFeAlO_4$, $NiFeAlO_4$, $CuAl_2O_4$, $CoAl_2O_4$, $FeAl_2O_4$, $FeAlFeO_4$, $NiAl_2O_4$, $MoAl_2O_4$, $MgFe_2O_4$, $CoFe_2O_4$, $NiFe_2O_4$, $CuFe_2O_4$, $ZnFe_2O_4$, $CdFe_2O_4$, $PbFe_2O_4$, $MgCo_2O_4$, $ZnCo_2O_4$, and $FeNi_2O_4$. The preferred bimetal spinels are the heavy metal aluminates, e.g., cobalt aluminate (Co $Al_2O_4$), nickel aluminate ($NiAl_2O_4$), and the iron aluminates ($FeAlFeO_4$, $FeAl_2O_4$). The bimetal spinels may be present as discrete clusters on the surface of the silicon substrate. A particularly satisfactory electrode is provided by an outer surface containing discrete masses of cobalt aluminate on a silion substrate having an underlying platinum coating thereon from 2 to 100 or more micro-inches thick disposed on the substrate. The bimetal spinels may also be present as a porous, external layer, with a conductive layer of platinum group metal or platinum group metal oxide, e.g., ruthenium oxide or platinum interposed between the base and the spinel coating. The bimetal spinel layer, having a porosity of from about 0.70 to about 0.95, and a thickness of from about 100 micro-inches to about 400 or more micro-inches thick provides added sites for surface catalyzed reactions. A particularly satisfactory electrode may be provided according to this exemplification having an electroconductive silicon substrate, an intermediate layer of platinum from 10 to 100 micro-inches thick, and a layer of cobalt aluminate spinel having a porosity of from about 0.70 to about 0.95 and a thickness of from about 100 to about 400 micro-inches thick. Alternatively, ruthenium dioxide may be substituted for the platinum, providing an electrode having a silicon substrate, a ruthenium dioxide layer in electrical and mechanical contact with the silicon substrate, and a layer of spinel on the ruthenium dioxide layer.

The steel plate 31*a*, 31*b*, 31*c* of the individual backplate 11, 12, 13 has a hydrogen outlet 61 extending therethrough from a catholyte chamber, as will be described more fully hereinafter, through the steel plate 31*a*, 31*b*, 31*c* and upward to a hydrogen header.

On the steel surface 31*b*, 31*c* of the individual backplate 12, 13 are steel cathode screens 35*a*, 35*b*. The steel cathode screens are typically in the form of a planar portion 36*a*, 36*b*, parallel to and spaced from the steel surface 31*b*, 31*c* of the backplate 12, 13 and a peripheral portion 38*a*, 38*b*, extending from the edges of the planar portion 36*a*, 36*b*, of the cathode screen 35*a*, 35*b*, to the steel plate 31*b*, 31*c* of the bipolar unit 12, 13. For example, the form thereof may be that of a truncated pyramid.

On the outer surface of the cathode screen 35*a*, 35*b*, is a permeable barrier 37*a*, 36*b*, 37*c*. This permeable barrier may be an asbestos diaphragm permeable to the anolyte liquor. Alternatively, it may be an artificial diaphragm permeable or partially permeable to the anolyte liquor. Alternatively, it may be a permionic membrane, permeable only to hydrogen ions and alkali metal ions but substantially impermeable to chloride ions.

Spacer means 41 are interposed with gasket means 43 between the steel plate 31 of the individual backplate and a silicon sheet 33 of the next adjacent backplate forming the peripheral walls of the individual electrolytic cell. Extending from the spacer 41*a*, 41*b*, 41*c* are gas outlet means 53 and liquid feed means 55 communicating with the interior of the individual electrolytic cells 21 and 22 through conduits 57 to brine feed box 51. Typically, brine is fed into the box 51 from a common header through lines 55 and evolved chlorine gas is withdrawn through line 53 from the brine box 51 after separation of the entrained electrolyte liquor therefrom in the brine feed box. The spacer means 41*a*, 41*b*, 41*c* may be fabricated of an injection molded or an extrusion molded material that is chemically resistant to chlorinated brines at temperatures of at least about 110° C. Satisfactory materials include the halocarbons, for example, chlorinated polyvinyl chloride, polytetrafluoroethylene, polyvinylfluoride, and polyvinylidene fluoride. The gasket means 43 are fabricated of resilient rubber, for example, foamed polyneoprene or foamed polychloroprene.

In the operation, brine is fed to the cell from brine header through conduit 55 to the brine box 51 and thence into the cell. An electrical potential is imposed across the bipolar electrolyzer sufficient to cause current to pass from the silicon sheet anode 33 of an individual cell through the permeable barrier 37 deposited on the cathode 35 of the cell to the steel plate 31 of the individual bipolar unit and thence through the individual bipolar unit to the silicon sheet 33 of the next adjacent electrolytic cell of the bipolar electrolyzer.

While the apparatus of this invention has been described with reference to specific features and embodiments thereof, the invention is not to be so limited except as defined in the claims appended hereto.

We claim:

1. In a bipolar electrolyzer having a first bipolar unit and a second bipolar unit, said second bipolar unit being spaced from and parallel to said first bipolar unit and defining a single electrolytic cell therebetween, each of said bipolar units having anode means on one surface thereof and cathode means on the opposite surface thereof whereby the cathode means of said first bipolar unit faces the anode means of the second bipolar unit, the improvement wherein at least one of said bipolar units comprises:

an electroconductive, electrolyte impermeable backplate having a steel plate as one exposed surface thereof, a silicon sheet in electrical contact with said steel plate as the opposite exposed surface of said backplate, and bonding means comprising a resilient electroconductive resinous material between said steel plate and said silicon sheet;

an electrocatalytic material on the exposed surface of the silicon sheet of said backplate; and electrolyte permeable, electroconductive cathode means electrically and mechanically connected to, spaced from, and parallel to said steel plate.

2. The electrolyzer of claim 1 wherein a perforated, resilient shim is interposed between said steel plate and silicon sheet, and the electroconductive resinous bonding extends from the steel plate through the perforated shim to the silicon sheet.

* * * * *